US007876344B2

(12) United States Patent
Suzuki

(10) Patent No.: US 7,876,344 B2
(45) Date of Patent: Jan. 25, 2011

(54) PHOTOGRAPHIC PRINTING METHOD, MANUFACTURING METHOD OF PHOTOGRAPHIC PRINTED MATERIAL, AND PRINTING APPARATUS

(75) Inventor: Yasuo Suzuki, Kanagawa (JP)

(73) Assignee: Sony Corporation, Tokyo (JP)

( * ) Notice: Subject to any disclaimer, the term of this patent is extended or adjusted under 35 U.S.C. 154(b) by 613 days.

(21) Appl. No.: 11/926,281

(22) Filed: Oct. 29, 2007

(65) Prior Publication Data

US 2008/0117277 A1 May 22, 2008

(30) Foreign Application Priority Data

Oct. 30, 2006 (JP) ..... 2006-294760

(51) Int. Cl.
*B41J 2/32* (2006.01)

(52) U.S. Cl. ..... 347/203

(58) Field of Classification Search ..... 347/203
See application file for complete search history.

(56) References Cited

U.S. PATENT DOCUMENTS

| | | | | |
|---|---|---|---|---|
| 6,362,132 | B1 * | 3/2002 | Simpson et al. | 503/227 |
| 6,989,350 | B2 * | 1/2006 | Hirota et al. | 503/227 |
| 2002/0088538 | A1 | 7/2002 | Suzuki | |
| 2003/0138599 | A1 * | 7/2003 | Kamikubo | 428/141 |

FOREIGN PATENT DOCUMENTS

| | | | |
|---|---|---|---|
| EP | 1186438 | A2 | 3/2002 |
| EP | 1329333 | A1 | 7/2003 |
| EP | 1386752 | A1 | 2/2004 |
| JP | 02026788 | | 1/1990 |
| JP | 02121886 | | 5/1990 |
| JP | 10-166746 | | 6/1998 |
| JP | 2003-211841 | | 7/2003 |
| JP | 2004-090282 | | 3/2004 |
| JP | 2004-122756 | | 4/2004 |
| JP | 2005-313356 | | 11/2005 |
| JP | 2005-335174 | | 12/2005 |

OTHER PUBLICATIONS

European Search Report issued on Jan. 30, 2008 in connection with European Patent Application No. 07020836.8.

* cited by examiner

*Primary Examiner*—Daniel Petkovsek
(74) *Attorney, Agent, or Firm*—SNR Denton US LLP

(57) ABSTRACT

A photographic printing method includes the steps of thermally transferring a color material onto a recording medium; further transferring an image protection layer thermally onto the recording medium having the color material; and processing the surface of the image protection layer so as to satisfy following conditions (1) to (6), (1) The 20° specular glossiness of the surface of the image protection layer is 30% or less;
(2) When the optical comb width is 2.0 mm, the image clarity value is 30% or less;
(3) When the optical comb width is 1.0 mm, the image clarity value is 5.0% or more;
(4) When the optical comb width is 0.5 mm, the image clarity value is 4.0% or more;
(5) When the optical comb width is 0.25 mm, the image clarity value is 3.0% or more; and
(6) When the optical comb width is 0.125 mm, the image clarity value is 3.0% or more.

10 Claims, 4 Drawing Sheets

PHOTOGRAPHIC PRINTING METHOD, MANUFACTURING METHOD OF PHOTOGRAPHIC PRINTED MATERIAL, AND PRINTING APPARATUS

CROSS REFERENCES TO RELATED APPLICATIONS

The present invention contains subject matter related to Japanese Patent Application JP 2006-294760 filed in the Japanese Patent Office on Oct. 30, 2006, the entire contents of which are incorporated herein by reference.

BACKGROUND OF THE INVENTION

1. Field of the Invention

The present invention relates to a photographic printing method for printing images on a photographic printed material having a silk-finished and glossy texture like a silver-film picture, a manufacturing method of the photographic printed material, and a printing apparatus.

2. Description of the Related Art

Photographic printing methods include a thermal transfer type in that a color material, such as dye, of a thermal transfer sheet is thermally transferred on a recording medium to form images. In this method, a transparent image protection layer is further formed on the images for protecting the images formed on the recording medium. This thermal transfer type process has a grey scale system that optionally controls the image density, so that high-quality images excellent in gradation and color reproduction and near to a silver-film picture can be obtained.

In this thermal-transfer type process, since the color material is thermally transferred on the recording medium, it is necessary to increase the transfer rate of the color material to the recording medium. Thus, the surface of the recording medium may generally be smooth so as to be easily transferred by a color material. Hence, in the thermal transferring photographic printing, the glossiness of the photographic printed material has a tendency to increase.

On the other hand, in the field of the silver-film picture, it has been well-known that there are a glossy finished surface and a silk finished surface, so that a user may select these through one's preference. Recently, a photographic printed material with a glossy and silk-finished surface may also have been further preferred. The surface processing of the photographic printed material has been described in Japanese Unexamined Patent Application Publications No. 2003-211841 and No. 2004-122756.

In Japanese Unexamined Patent Application Publication No. 2003-211841, when the relative-specular glossiness of the surface of a thermal-transfer resin layer is less than 65% at a measurement angle of 60° measured in compliance with JIS Z 8741 (Japanese Industrial Standards) in the transferred photographic printed material, the glare due to light reflection during observing images can be prevented. However, this document has a purpose for preventing the glare, i.e., the matte finish, and has no purpose for achieving a glossy and silk-finished photographic printed material. In the measurement of the glossiness, with increasing glossiness, the measurement angle is generally reduced; whereas, in this document, the measurement angle is 60°, so that the matte finished photographic printed material, i.e., the low glossy material, has been discussed.

The documents concerning the matte finish include Japanese Unexamined Patent Application Publication No. 2004-122756; however, any document does not achieve the glossy and silk-finished photographic printed material.

SUMMARY OF THE INVENTION

The present invention has been made in view of the problems described above, and it is desirable to provide a photographic printing method, a manufacturing method of a photographic printed material, and a printing apparatus that are capable of providing a photographic printed material having silk finish and glossy texture close to a silver-film picture by characterizing the printed surface as having a relative-specular glossiness and an image clarity value.

According to an embodiment of the present invention, there are provided a photographic printing method, a manufacturing method of a photographic printed material, and a printing apparatus for obtaining the silk-finished photographic printed material having glossy texture close to a silver-film picture by embossing a laminated image protection layer so as to have a specific relative-specular glossiness and a specific image clarity value during recording in a thermal transfer system.

Namely, in the photographic printing method according to the embodiment of the present invention, a color material of a thermal transfer sheet is thermally transferred onto a recording medium and the image protection layer is further transferred thermally onto the recording medium having the color material thermally transferred thereon; then, the surface of the thermally transferred image protection layer is micro-embossed so as to satisfy the following conditions (1) to (5), thereby obtaining the silk-finished photographic printed material having glossy texture close to a silver-film picture.

In general, the glossy texture is measured by a gloss meter. According to the embodiment of the present invention, the following condition (1) is provided:

(1) The 20° relative-specular glossiness (JIS P 8142) of the surface of the image protection layer thermally transferred on the recording medium is 30% or less.

The 20° relative-specular glossiness, which is the condition (1), is obtained by Specular glossiness-Method of measurement standardized in JIS P 8142. In the measurement herein, the gloss meter Model VG2000 made from NIPPON DENSHOKU Co., Ltd. is used and the incident and reflection angle to/from the light source is set at 20°. In JIS P 8142, the incident and reflection angle is provided as 20°, 45°, 60°, 75°, and 85°. The higher glossiness, the smaller incident angle is generally set. According to the embodiment of the present invention, as described above, it is desirable to obtain a photographic printed material having a silk-finished and glossy texture close to a silver-film picture, so that the specular glossiness is measured at an incident and reflection angle of 20°.

According to the embodiment of the present invention, the following condition (2) is provided for the surface of the image protection layer thermally transferred on the recording medium:

(2) When an optical comb with a width of 2.0 mm is used, the image clarity value (JIS H 8686) is 30% or less.

The image clarity value herein is obtained from "Test methods of image clarity" standardized in JIS H 8686. Specifically, the image clarity value is obtained from the fluctuating waveform of the light quantity detected through the optical comb according to the following equation using an image clarity measuring instrument composed of an optical device for detecting the reflection light incident via a slit on a target measurement surface at an angle of 45° (a light receiving angle of 45°) through the moving optical comb and a measuring device for storing the fluctuation of the detected light quantity as a waveform:

$$C(n)=(M-m)/(M+m)\times 100,$$

where C(n) is the image clarity value (%) when an optical comb with a width of n (mm) is used; M is the maximum wave height when the width of the optical comb is n (mm); and m is the minimum wave height when the width of the optical comb is n (mm). In the measurement herein, as the image clarity measuring device, Model ICM-1 made from SUGA Test INSTRUMENTS Co., Ltd. is used, and the width of the optical comb is 2.0 mm.

As described above, the reason why the conditions (1) and (2) are provided is that sometimes the glossiness value is different from the gloss texture measured by visual observation, so that the image clarity value is also provided as a physical property value expressing visual observed glossiness. From experimental results, it has been understood that among surfaces rejected by visual observation, there are some surfaces with a 20° relative-specular glossiness (JIS P 8142) of 30% or less while the image clarity value is larger; oppositely, there are some surfaces with a 200 relative-specular glossiness (JIS P 8142) of above 30% while the image clarity value is smaller. Then, according to the embodiment of the present invention, the 200 relative-specular glossiness is first provided as the condition (1) while the image clarity value when an optical comb with a width of 2.0 mm is used is provided as the condition (2).

Furthermore, on the surface with large roughness of the photographic printed material, incident light is scattered so that light quantity detected by a light receiving unit is reduced smaller than the surface with small roughness. The image clarity value when an optical comb with a width of 2.0 mm is generally adopted; with decreasing width of the optical comb, the fluctuation of the waveform of the light quantity detected through the optical comb is reduced. However, since the light quantity detected by the light receiving unit is originally and extremely small, in comparison with the surface with a greater receiving light quantity (with smaller roughness), the value (M+m) in the calculating equation of the image clarity value $C(n)=(M-m)/(M+m)\times 100$ is reduced. Hence, the image clarity value when the width of the optical comb is 1.0 mm or less is used of the printed surface with greater dispersion is increased larger than that of the surface with smaller roughness.

Then, according to the embodiment of the present invention, under the following conditions (3) to (6), the image clarity value when an optical comb with a width of 1.0 mm or less is used (JIS H 8686) of the surface of the image protection layer thermally transferred on the recording medium is provided:

(3) The image clarity value when an optical comb with a width of 1.0 mm is used (JIS H 8686) is 5.0% or more;

(4) The image clarity value when an optical comb with a width of 0.5 mm is used (JIS H 8686) is 4.0% or more;

(5) The image clarity value when an optical comb with a width of 0.25 mm is used (JIS H 8686) is 3.0% or more; and (6) The image clarity value when an optical comb with a width of 0.125 mm is used (JIS H 8686) is 3.0% or more.

As described above, by processing the surface of the image protection layer thermally transferred on the recording medium so as to satisfy the conditions (1) to (6), a silk-finished photographic printed material having glossy texture more close to a silver-film picture can be obtained.

The surface processing may be herein performed by applying fluctuating thermal energy on the surface of the image protection layer with the thermal head; alternatively, by pressing a transfer roller with a roughness surface on the surface of the image protection layer.

According to the embodiment of the present invention, in a photographic printed material made by thermally transferring a color material of a thermal transfer sheet onto a recording medium and further by transferring thermally the image protection layer onto the recording medium having the color material thermally transferred thereon, the above-mentioned conditions (1) to (6) are satisfied by the relative-specular glossiness and the image clarity value of the surface of the thermally transferred image protection layer, so that a silk-finished photographic printed material having glossy texture close to a silver-film picture can be obtained.

DESCRIPTION OF THE PREFERRED EMBODIMENTS

A sublimation printer apparatus and a photographic printing method using the printer apparatus according to an embodiment of the present invention will be described with reference to the drawings.

Figure 1:
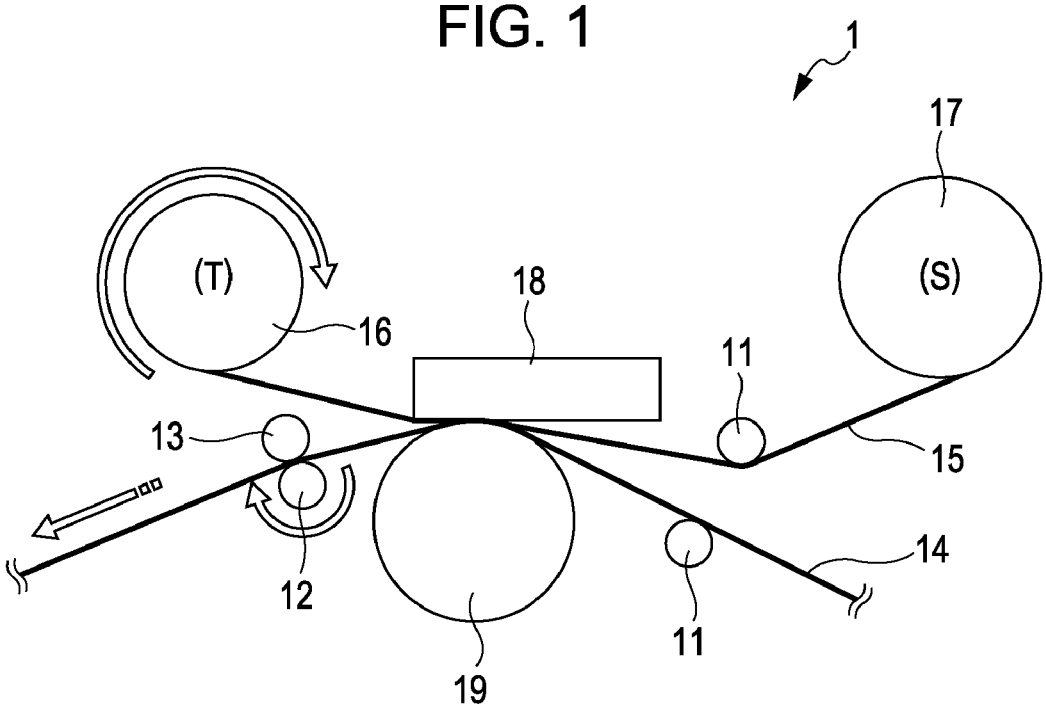
FIG. 1 is a structural drawing of a printer apparatus according to an embodiment of the present invention.

A printer apparatus 1, as shown in FIG. 1, drives a recording medium 14, such as photographic paper, to travel by guiding it with a guide roller 11 and pinching it between a capstan 12 and a pinch roller 13. A cartridge accommodating a thermal transfer sheet 15 is mounted on the printer apparatus 1, and the thermal transfer sheet 15 travels from a feed reel 17 toward a winding reel 16 by the rotational driving of the winding reel 16. At a printing position where ink of the thermal transfer sheet 15 is transferred on the recording medium 14, a thermal head 18 is arranged to oppose a platen roller 19. From the thermal transfer sheet 15, dye is sublimated and thermally transferred on the recording medium 14 while the recording medium 14 is being pressurized by the thermal head 18 under a predetermined pressure.

Figure 2:
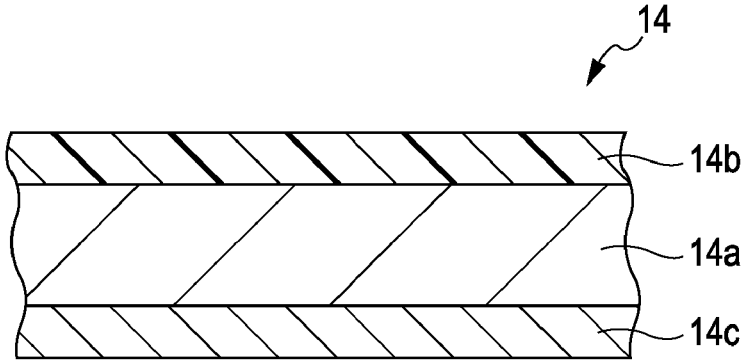
FIG. 2 is a sectional view of an essential part of a recording medium used in the printer apparatus according to the embodiment.

Upon describing the recording medium 14 herein with reference to FIG. 2, the recording medium 14 includes a base material 14*a* made of paper (pulp), polypropylene (PP), or polyethylene terephthalate (PET); and a receptor layer 14*b* formed on one surface of the base material 14*a* for receiving dye transferred from the thermal transfer sheet 15 so as to hold the received dye. The receptor layer 14*b* is formed of a thermoplastic resin, such as an acrylic resin, polyester, polycarbonate, or polyvinyl chloride. On the other surface of the base material 14*a*, a back layer 14*c* is formed for reducing the friction to the guide roller 11 and the platen roller 19.

Figure 3:
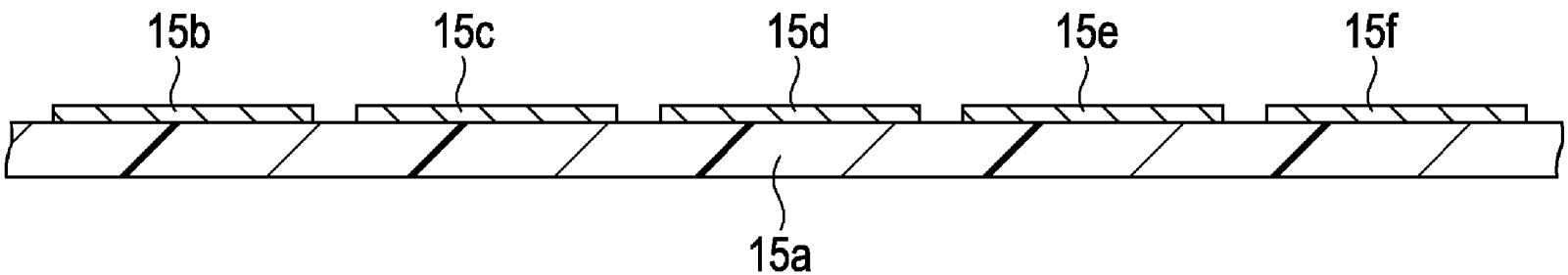
FIG. 3 is a sectional view of a thermal transfer sheet used in the printer apparatus according to the embodiment.

On the other hand, as shown in FIG. 3, the thermal transfer sheet 15 includes a base material 15*a* made of a synthetic resin film, such as a polyester film or a polystyrene film; dye layers 15*b*, 15*c*, 15*d*, and 15*e* formed on one surface of the base material 15*a* and respectively composed of yellow, magenta, cyan, and black dyes for forming images and a thermoplastic resin; and an image protection layer 15*f* formed on the one surface of the base material 15*a* and made of the same thermoplastic resin as that of the dye layers 15*b*, 15*c*, 15*d*, and 15*e*. On the base material 15*a*, these layers 15*b* to 15*f* are sequentially arranged in the longitudinal direction in sets of the dye layers 15*b*, 15*c*, 15*d*, and 15*e* and the image protection layer 15*f*. When the thermal energy corresponding to image data to be printed is applied to the dye layers 15*b*, 15*c*, 15*d*, and 15*e* from the thermal head 18, the dye layers 15*b*, 15*c*, 15*d*, and 15*e* are thermally transferred on the receptor layer 14*b* of the recording medium 14 by the sublimation.

Specifically, each of the dye layers 15*b*, 15*c*, 15*d*, and 15*e* is composed of a cellulose resin, such as methyl cellulose, ethyl cellulose, hydroxyethyl cellulose, or hydroxybutyl cellulose; a vinyl resin, such as polyvinyl alcohol, polyvinyl butyral, polyvinyl acetacetal, polyvinyl acetate, or polystyrene; and various urethane resins; each having sublimation or thermal diffusion dye dispersed therein.

The image protection layer 15*f* is formed of a thermoplastic resin, such as a polyester resin or ester cellulose; and additionally, an ultraviolet absorber, a light stabilizer, and an anti-oxidant may be further added thereto for improving image conservation.

The image protection layer 15*f* is further thermally transferred on the images formed by the thermally transferred dye layers 15*b*, 15*c*, 15*d*, and 15*e*. At this time, the surface of the image protection layer 15*f* thermally transferred on the recording medium 14 is processed to have micro-roughness with the thermal energy of the thermal head 18 or a pressing roller for silk-finishing.

The configurations of the thermal transfer sheet 15 according to the embodiment of the present invention are not particularly limited as long as the image protection layer is provided. Thus, the thermal transfer sheet 15 according to the embodiment of the present invention may also have at least one dye layer and the image protection layer in addition to having only the image protection layer. For example, the thermal transfer sheet 15 may be composed of the black dye layer and the image protection layer; alternatively, it may be composed of the yellow, magenta, and cyan dye layers and the image protection layer. Furthermore, the color material may include pigment instead of the dye.

Figure 4:
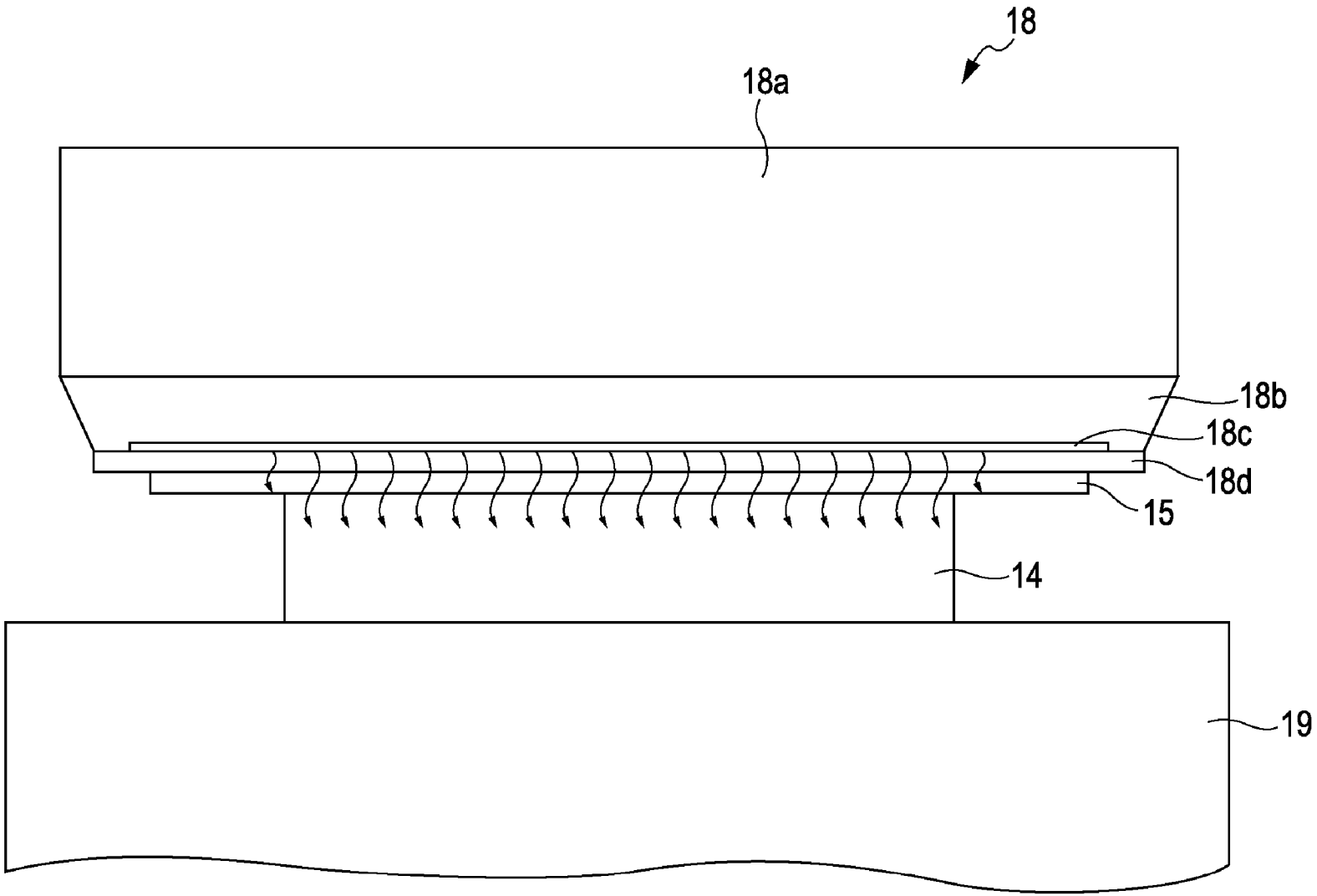
FIG. 4 is a front view of a thermal head of the printer apparatus according to the embodiment.

The thermal head 18, as shown in FIG. 4, includes a ceramic substrate 18*a*, a glaze layer 18*b*, a heater element 18*c* made of an exothermic body and formed in line on the ceramic substrate 18*a* with the glaze layer 18*b* therebetween, and a protection layer 18*d* formed on the heater element 18*c* for protecting the heater element 18*c*. The ceramic substrate 18*a* is excellent in heat dissipation effect and has a function preventing the heater element 18*c* from accumulating heat. The glaze layer 18*b* protrudes the heater element 18*c* toward the recording medium 14 and the thermal transfer sheet 15 for making the heater element 18*c* abut the recording medium 14 and the thermal transfer sheet 15, and it also serves as a buffer layer for preventing the heat of the heater element 18*c* from being excessively absorbed to the ceramic substrate 18*a*. The thermal head 18 heats and sublimates the dye of the thermal transfer sheet 15 disposed between the recording medium 14 and the heater element 18*c* every one line so as to be transferred on the recording medium 14.

Figure 5:
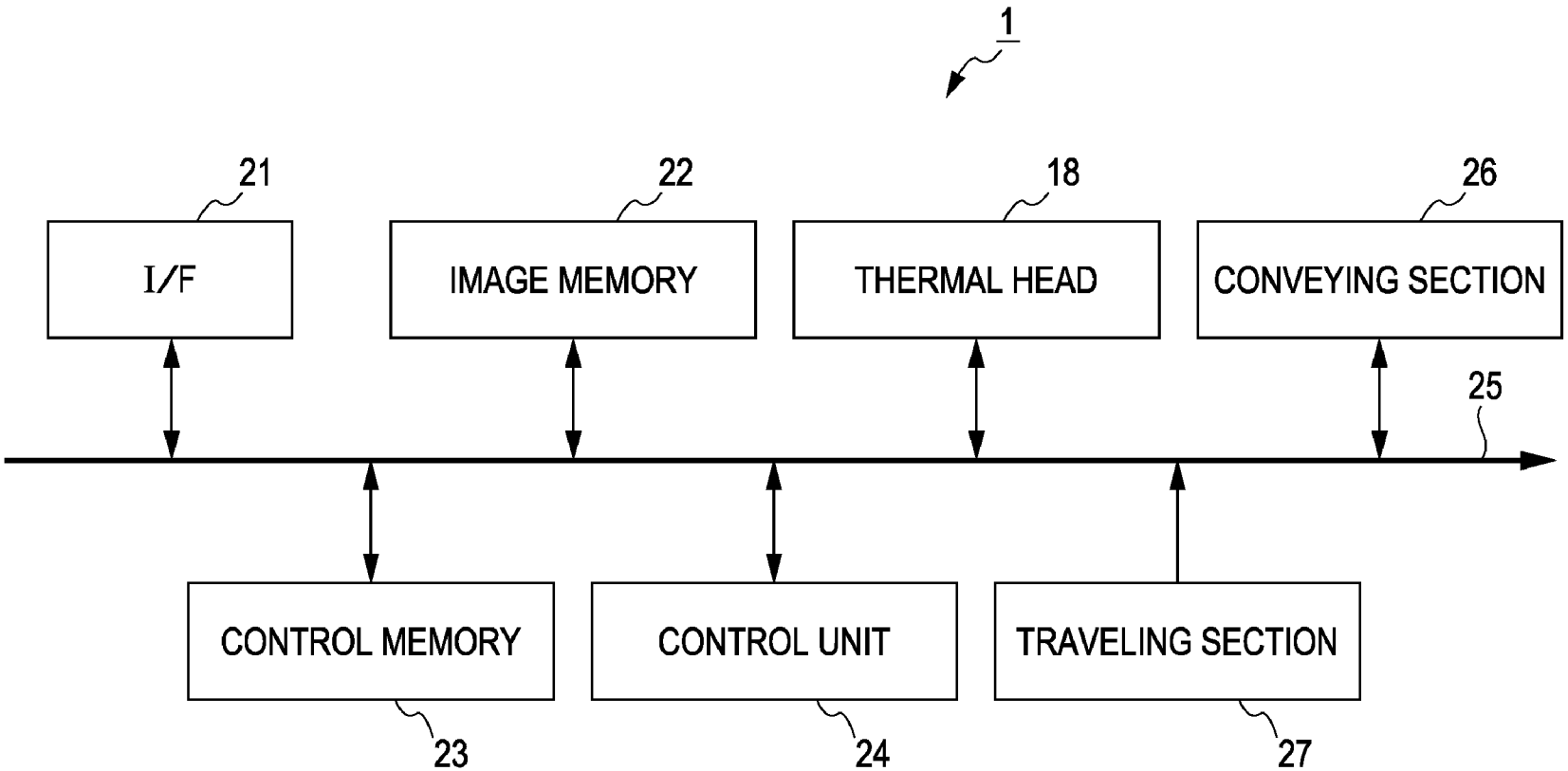
FIG. 5 is a block diagram of the printer apparatus according to the embodiment.

The circuit of the printer apparatus 1 configured as described above will be described. As shown in FIG. 5, in the printer apparatus 1, an interface (simply referred to as an I/F below) 21 receiving image data to be printed, an image memory 22 storing the image data received by the I/F 21, a control memory 23 storing a control program, and a control unit 24 for controlling operations of the entire components, such as the thermal head 18, are connected together via a bus 25. To the bus 25, a capstan 12 for driving the recording medium 14 to travel from a feed section to a discharge section, a conveying section 26 having a motor for driving the capstan 12, and a traveling section 27 having the thermal head 18 and a motor for driving the winding reel 16 for driving the thermal transfer sheet 15 are also connected so that the conveying section 26 and the traveling section 27 are also controlled by the control unit 24.

To the I/F 21, connected are a display, such as an LCD (liquid crystal display) displaying images to be printed and a CRT (cathode ray tube), and electric instruments, such as a recording/reproducing device having a recording medium loaded thereon. For example, when moving images are displayed on the display, static images selected by a user are inputted to the I/F 21. When the recording/reproducing device is connected to the I/F 21, static image data recorded on the recording medium, such as an optical disc and an IC card, is inputted in the I/F 21. The electric instrument is connected to the I/F 21 in wired or wireless transmission in conformity to standards such as the USB (universal serial bus), the IEEE (institute of electrical and electronic engineers) 1394, and the blue tooth.

The image memory 22 has a capacity storing at least the image data corresponding to one disc, and receives the image data to be printed from the I/F 21 so as to be temporarily stored. In the control memory 23, a control program is stored for controlling entire operations of the printer apparatus 1. The control unit 24 controls the entire operations based on the control program stored in the control memory 23. For example, the control unit 24 controls the conveying section 26 for switching the conveying speed of the recording medium 14 between the speed during image forming and that during image protection layer forming, while controlling the thermal head 18 in accordance with the images to be printed.

The printing operation of the printer apparatus 1 configured as described above will be herein described. The control unit 24 controls the conveying section 26 in accordance with the program stored in the control memory 23 so as to convey the printing-starting portion of the recording medium 14 to the position of the thermal head 18. The control unit 24 also controls the traveling section 27 so as to drive the thermal transfer sheet 15 for thermally transferring the yellow, magenta, cyan, and black dye layers 15*b*, 15*c*, 15*d*, and 15*e*; and the image protection layer 15*f* on the conveyed recording medium 14 in that order. Then, the control unit 24 drives the thermal head 18 in accordance with the printing data, while running the recording medium 14 at high speed, so as to thermally transfer the dye layers 15*b* to 15*e* of the thermal transfer sheet 15 in that order for forming images, having respective densities corresponding to the image data, on the recording medium 14. Then, the image protection layer 15*f* is thermally transferred on the images while the recording medium 14 is being driven to travel at a speed lower than that during the image forming. At this time, the surface of the transferred image protection layer 15*f* is processed to have micro-roughness by the control unit 24 so that the surface is silk finished.

Specifically, the control unit 24 controls the thermal head 18 so that (1) the 20° relative-specular glossiness (JIS P 8142) of the surface of the image protection layer thermally transferred on the recording medium becomes 30% or less, preferably 20% or less. The 20° relative-specular glossiness, which is the condition of item (1), is obtained from "Specular glossiness-Method of measurement" standardized in JIS P 8142. In the measurement herein, the gloss meter Model VG2000 made from NIPPON DENSHOKU Co., Ltd. was used and the incident and reflection angle to/from the light source was set at 20°. In JIS P 8142, the incident and reflection angle is provided as 20°, 45°, 60°, 75°, and 85°. The higher glossiness, the smaller incident angle is generally set. According to the embodiment of the present invention, as described above, it is desirable to obtain a silk-finished photographic printed material having glossy texture close to a silver-film picture, so that the glossiness at an incident and reflection angle of 20° was provided.

Also, the control unit 24 controls the thermal head 18 so that (2) the image clarity value when an optical comb with a width of 2.0 mm is used (JIS H 8686) of the surface of the image protection layer thermally transferred on the recording medium becomes 30% or less, preferably 20% or less. The image clarity value is herein obtained from "Test methods of image clarity" standardized in JIS H 8686. Specifically, the image clarity value is obtained from the fluctuating waveform of the light quantity detected through the optical comb according to the following equation using an image clarity measuring instrument composed of an optical device for detecting the reflection light incident via a slit on a target measurement surface at an angle of 45° (a light receiving angle of 45°) through the moving optical comb and a measuring device for storing the fluctuation of the detected light quantity as a waveform.

$$C(n)=(M-m)/(M+m)\times 100,$$

where C(n) is the image clarity value (%) when an optical comb with a width of n (mm) is used; M is the maximum wave height when the width of the optical comb is n (mm); and m is the minimum wave height when the width of the optical comb is n (mm). In the measurement herein, as the image clarity measuring device, Model ICM-1 made from SUGA Test INSTRUMENTS Co., Ltd. was used, and the width of the optical comb was 2.0 mm.

Thereby, even when the above condition (1) that the 20° relative-specular glossiness (JIS P 8142) of the surface of the image protection layer thermally transferred on the recording medium is 30% or less is satisfied, the excessively higher image clarity value (JIS H 8686) can be removed.

The surface with greater roughness of the photographic printed material reduces the light quantity detected by a light receiving unit due to the dispersion of incident light on the surface of the photographic printed material lower than the surface with smaller roughness. In general, the image clarity value when the width of the optical comb is 2.0 mm is used is adopted; with decreasing width of the optical comb, the fluctuation of the waveform of the light quantity detected through the optical comb is reduced. However, since the light quantity detected by the light receiving unit is originally and extremely small, in comparison with the surface with a greater receiving light quantity (with smaller roughness), the value (M+m) in the calculating equation of the image clarity value C(n)=(M−m)/(M+m)×100 is reduced. Hence, the image clarity value when the width of the optical comb is 1.0 mm or less is used of the printed surface with greater dispersion is increased larger than that of the surface with smaller roughness.

Then, according to the embodiment of the present invention, under the following conditions (3) to (6), the image clarity value when an optical comb with a width of 1.0 mm or less is used (JIS H 8686) of the surface of the image protection layer thermally transferred on the recording medium is provided:

(3) The image clarity value when an optical comb with a width of 1.0 mm is used (JIS H 8686) is 5.0% or more, preferably 6.0% or more;

(4) The image clarity value when an optical comb with a width of 0.5 mm is used (JIS H 8686) is 4.0% or more, preferably 5.0% or more;

(5) The image clarity value when an optical comb with a width of 0.25 mm is used (JIS H 8686) is 3.0% or more, preferably 4.0% or more; and (6) The image clarity value when an optical comb with a width of 0.125 mm is used (JIS H 8686) is 3.0% or more, preferably 4.0% or more.

In such a manner, the control unit 24 drives the thermal head 18 so as to satisfy the conditions (3) to (6) for silk-finishing the surface of the image protection layer 15*f* by processing the surface to have micro-roughness.

According to the above embodiment, the surface of the image protection layer 15*f* transferred on the recording medium 14 is silk-finished by driving the thermal head 18 with the control unit 24; alternatively, according to the embodiment, a transfer roller with a roughness surface may be built in the printer apparatus 1, and after the image protection layer 15*f* is transferred on the printed recording medium 14, the transfer roller may be pressurized on the surface of the image protection layer 15*f* for silk-finishing the surface by the micro-embossing. In this case, the transfer roller may be built in the printer apparatus or may be a separated component. In the embossing using the transfer roller, the recording medium 14 having the transferred image protection layer 15*f* and/or the transfer roller are heated to soften the transferred image protection layer 15*f* for transferring the roughness on the image protection layer 15*f*.

EXAMPLES

Example 1

The specification will be described of the printer apparatus for printing photographic printed materials used for measuring the 20° relative-specular glossiness (JIS P 8142) of the surface of the image protection layer 15*f* thermally transferred on the recording medium 14; and the image clarity values when optical combs with a width of 2.0 mm, 1.0 mm, 0.5 mm, 0.25 mm, and 0.125 mm are used (JIS H 8686). In the used printer apparatus, images are thermally transferred on the recording medium 14 with thermal head and furthermore, the image protection layer 15*f* is thermally transferred thereon, and the printer Model UP-D75 made from SONY CORPORATION was used.

A personal computer (OS: Windows™XP, referred to as a computer below) was used for producing image data and transferring the produced image data to the printer apparatus, and the computer was connected to the printer apparatus via a UBS cable. In the computer, the black-solid image data was produced using the software (Adobe Photo Shop) made from Adobe Systems Incorporated. The image data was transferred to the printer apparatus so as to print black-solid images at a comparatively slow line speed of 4 msec/line using a set of an ink ribbon and photographic paper (base: sheet (size A4)+polypropylene (PP)) as the thermal transfer sheet Model UPC-747 made from SONY CORPORATION. Thereafter, the image protection layer 15*f* was laminated on the black-solid images at a line speed of 8 msec/line in a "mat" mode of photographic printing (a silk-finished mode according to the embodiment of the present invention).

Example 2

The same photographic printing as in Example 1 was performed except for the line speed: 6 msec/line during the laminating.

Example 3

The same photographic printing as in Example 1 was performed except for the line speed: 4 msec/line during the laminating.

Namely, the line speed during the laminating was increased toward Example 3 from Example 1.

Example 4

In Example 4, the printer Model UP-DR150 made from SONY CORPORATION was used for thermally transferring images with thermal head and then, for thermally transferring the image protection layer 15*f* thereon. This printer can print photographic images with resolution higher than by the printer Model UP-D75 used in Examples 1 to 3. The computer was used for producing image data and transferring the produced image data to the video printer, and the computer was connected to the video printer via a UBS cable. In the computer, the black-solid image data was produced using the software (Adobe Photo Shop) made from Adobe Corporation. The image data was transferred to the printer so as to print black-solid images at a line speed of 0.7 msec/line using the ink ribbon (Model 2UPC-R156 made from SONY CORPORATION) and photographic paper (base: PP, size: 2 KG, paper thickness: 0.22 mm). Thereafter, the image protection layer 15*f* was laminated on the black-solid images in a built-in laminate pattern at a line speed of 0.7 msec/line in a "mat" mode of photographic printing (a silk-finished mode according to the embodiment of the present invention).

Comparative Example 1

The same photographic printing as in Example 4 was performed except for the photographic material: (base: paper (pulp), size: 2 KG, paper thickness: 0.22 mm).

Comparative Example 2

The same photographic printing as in Example 4 was performed except for the photographic material: the honest paper UPC-R156 (base: polyethylene terephthalate (PET)).

Example 5

The embossing will be subsequently described. After the black-solid images were printed at a line speed of 0.7 msec/line using the ink ribbon (Model 2UPC-R156 made from SONY CORPORATION) and photographic paper (base: PP, size: 2 KG, paper thickness: 0.22 mm) by the printer Model UP-DR150 in the same way as above, the image protection layer 15*f* was laminated on the black-solid images in a built-in laminate pattern at a line speed of 0.7 msec/line in a "glossy" mode of photographic printing. Thereafter, the printed photographic paper is embossed with a miniature super calender made from YURI ROLL MACHINE CO., LTD. The roughness pattern of the roll is the orange peel pattern "fine-grained surface #350"; the rotational speed of the roll is 27 mm/s; the linear load is 200 kN/m; and the embossing was performed without slippage between the roll and the photographic paper.

Example 6

The same photographic printing and embossing as in Example 5 were performed except for the linear load; 66.7 kN/m.

Example 7

The same photographic printing and embossing as in Example 5 were performed except for the linear load; 33.3 kN/m.

Comparative Example 3

The same photographic printing and embossing as in Example 5 were performed except for the linear load; 16.7 kN/m.

Example 8

The same photographic printing and embossing as in Example 5 were performed except for the photographic paper: the honest paper UPC-R156.

Example 9

The same photographic printing and embossing as in Example 8 were performed except for the linear load; 66.7 kN/m.

Comparative Example 4

The same photographic printing and embossing as in Example 8 were performed except for the linear load; 33.3 kN/m.

Comparative Example 5

The same photographic printing and embossing as in Example 8 were performed except for the linear load; 16.7 kN/m.

Comparative Example 6

The same photographic printing and embossing as in Example 5 were performed except for the photographic paper (base: paper, size: 2 KG, paper thickness: 0.22 mm).

Example 10

The same photographic printing and embossing as in Example 6 were performed except for the linear load; 66.7 kN/m.

Comparative Example 7

The same photographic printing and embossing as in Example 6 were performed except for the linear load; 33.3 kN/m.

Comparative Example 8

The same photographic printing and embossing as in Example 6 were performed except for the linear load; 16.7 kN/m.

(Evaluation)

In comparison with the photographic images on Kodak Royal paper and Edge paper as a glossy- and silk-finished surface on a silver-film picture, the glossiness and the surface nature of the recorded images are evaluated by visual observation in the following three steps:

o: The silk finished surface with the same glossiness as in the silver-film picture; very excellent, Δ: The surface with more glossiness than that of the silver-film picture, bearing silk traces; excellent, x: The surface with excessively more glossiness than that of the silver-film picture, bearing scarcely silk traces; no good.

Then, the glossy levels of the photographic printed surfaces in Examples and Comparative Examples described above were measured with a relative-specular glossiness tester (the gloss meter Model VG2000 made from NIPPON DENSHOKU Co., Ltd.) in compliance with JIS P 8142. The size of the test piece was 50×50 mm and three pieces ware prepared for each test. When the incident and reflection angle to/from the light source was set at 20°, the relative-specular glossiness was measured. In the measurement, the glossiness was measured three times so that the incident direction from the light source is perpendicular to the printing direction of the photographic material; the glossiness was measured three times so that the incident direction from the light source is in parallel with the printing direction of the photographic material, so that the average of six measurements in total from the three test pieces was to be the glossiness.

Then, the image clarity values of the photographic printed surfaces in Examples and Comparative Examples described above were measured with the image clarity measuring device (Model ICM-1 made from SUGA Test INSTRUMENTS Co., Ltd.). The used test piece was that for the relative-specular glossiness measuring. In the measurement by the reflection method (45°), the image clarity value was measured three times so that the incident direction from the light source is perpendicular to the printing direction of the photographic material; the image clarity value was measured three times so that the incident direction from the light source is in parallel with the printing direction of the photographic material, so that the average of six measurements in total from the three test pieces was to be the image clarity value (in compliance with JIS H 8686).

The evaluated results by the visual observation and the measured results of the relative-specular glossiness and the image clarity value are shown in Table 1.

TABLE 1

| ROUGHNESS PROCESSING | | VISUAL DETERMINATION | 20° SPECULAR GLOSSINESS % | IMAGE CLARITY VALUE %/SLIT WIDTH MM 0.125 | 0.25 | 0.5 | 1 | 2 | BASE MATERIAL |
|---|---|---|---|---|---|---|---|---|---|
| THERMAL ENERGY | EXAMPLE 1 | o | 16.7 | 4.4 | 4.5 | 5.5 | 6.2 | 20.4 | PP |
| | EXAMPLE 2 | Δ | 18.9 | 3.2 | 3.4 | 4.2 | 6.9 | 29.4 | PP |
| | EXAMPLE 3 | Δ | 20.0 | 4.4 | 4.7 | 4.9 | 9.4 | 24.9 | PP |
| | EXAMPLE 4 | o | 19.1 | 3.9 | 4.7 | 5.2 | 5.8 | 16.6 | PP |
| | COMPARATIVE EXAMPLE 1 | x | 59.8 | 2.6 | 2.6 | 3.1 | 6.6 | 37.8 | PAPER |
| | COMPARATIVE EXAMPLE 2 | x | 31.4 | 3.9 | 4.2 | 4.6 | 4.5 | 17.1 | PET |
| EMBOSSING | EXAMPLE 5 | o | 6.0 | 5.8 | 7.9 | 9.2 | 9.0 | 19.3 | PP |
| | EXAMPLE 6 | o | 13.1 | 4.8 | 5.8 | 5.9 | 6.6 | 17.6 | PP |
| | EXAMPLE 7 | Δ | 22.9 | 3.6 | 3.9 | 4.6 | 5.9 | 20.7 | PP |
| | COMPARATIVE EXAMPLE 3 | x | 32.1 | 3.0 | 3.5 | 3.7 | 6.1 | 22.0 | PP |
| | EXAMPLE 8 | o | 9.9 | 5.0 | 6.1 | 6.4 | 6.5 | 17.4 | PP |
| | EXAMPLE 9 | Δ | 29.9 | 3.9 | 4.5 | 4.4 | 5.0 | 21.1 | PP |
| | COMPARATIVE EXAMPLE 4 | x | 45.8 | 2.9 | 3.2 | 3.8 | 3.6 | 26.1 | PP |
| | COMPARATIVE EXAMPLE 5 | x | 58.6 | 2.9 | 2.6 | 3.0 | 4.0 | 31.9 | PP |
| | COMPARATIVE EXAMPLE 6 | x | 0.9 | 22.9 | 23.3 | 26.3 | 28.7 | 33.5 | PAPER |
| | EXAMPLE 10 | Δ | 2.1 | 15.0 | 15.1 | 15.9 | 16.7 | 23.4 | PAPER |
| | COMPARATIVE EXAMPLE 7 | x | 35.2 | 2.8 | 2.9 | 3.3 | 5.7 | 23.2 | PAPER |
| | COMPARATIVE EXAMPLE 8 | x | 40.6 | 3.0 | 3.2 | 3.2 | 5.7 | 25.0 | PAPER |

As is apparent from Table 1, when (1) the 20° relative-specular glossiness (JIS P 8142) of the surface of the image protection layer thermally transferred on the recording medium is 30% or less; (2) the image clarity value when an optical comb with a width of 2.0 mm is used (JIS H 8686) is 30% or less; (3) the image clarity value when an optical comb with a width of 1.0 mm is used (JIS H 8686) is 5.0% or more; (4) the image clarity value when an optical comb with a width of 0.5 mm is used (JIS H 8686) is 4.0% or more; (5) the image clarity value when an optical comb with a width of 0.25 mm is used (JIS H 8686) is 3.0% or more; and (6) the image clarity value when an optical comb with a width of 0.125 mm is used (JIS H 8686) is 3.0% or more, that is, in Examples 1 to 10 that satisfy the entire conditions (1) to (6), it is confirmed that the photographic printing is determined to be excellent by the visual observation.

In particular, when (1') the 20° relative-specular glossiness (JIS P 8142) of the surface of the image protection layer thermally transferred on the recording medium is 20% or less; (2') the image clarity value when an optical comb with a width of 2.0 mm is used (JIS H 8686) is 20% or less; (3') the image clarity value when an optical comb with a width of 1.0 mm is used (JIS H 8686) is 6.0% or more; (4') the image clarity value when an optical comb with a width of 0.5 mm is used (JIS H 8686) is 5.0% or more; (5') the image clarity value when an optical comb with a width of 0.25 mm is used (JIS H 8686) is 4.0% or more; and (6') the image clarity value when an optical comb with a width of 0.125 mm is used (JIS H 8686) is 4.0% or more, that is, in Examples 1, 4, 5, 6, and 8, the photographic printing is determined to be excellent especially by the visual observation. In Example 4, the image clarity value when an optical comb with a width of 0.125 mm is used (JIS H 8686) is 3.9%; however, it is slightly smaller than 4.0%, which is the condition (6'), so that excellent results were obtained.

Considering the base material 14*a* of the recording medium 14, the PP base may frequently satisfy the conditions (1) to (6) while the PET and paper (pulp) bases have no tendency to satisfy the conditions (1) to (6). The reason why PP is preferable than PET is that the softening temperature of PP is lower than that of PET and being deformable due to thermal energy. The reason why PP is preferable than paper (pulp) is that paper has resilience more than PP so that the roughness formed by applying a load is easily renatured. That is, the base material 14*a* of the recording medium 14 is one of factors of the surface processing. It is understood that in order to form micro-roughness satisfying the above-mentioned conditions (1) to (6) by applying thermal energy, the thermoplastic resin base having low softening temperature is preferable while for forming micro-roughness satisfying the above-mentioned conditions (1) to (6) by applying a load, a resin base with low resilience is preferable.

It should be understood by those skilled in the art that various modifications, combinations, sub-combinations and alterations may occur depending on design requirements and other factors insofar as they are within the scope of the appended claims or the equivalents thereof.

What is claimed is:

1. A photographic printing method, comprising the steps of:

thermally transferring a color material of a thermal transfer sheet onto a recording medium;

further transferring an image protection layer thermally onto the recording medium having the color material thermally transferred thereon; and processing the surface of the image protection layer thermally transferred on the recording medium so as to satisfy all of the following conditions (1) to (6):

(1) the 20° relative-specular glossiness (JIS P 8142) of the surface of the image protection layer thermally transferred on the recording medium is 30% or less, (2) the image clarity value (JIS H 8686) as measured using an optical comb with a width of 2.0 mm is 30% or less, (3) the image clarity value (JIS H 8686) as measured using an optical comb with a width of 1.0 mm is 5.0% or more, (4) the image clarity value (JIS H 8686) as measured using an optical comb with a width of 0.5 mm is 4.0% or more, (5) the image clarity value (JIS H 8686) as measured using an optical comb with a width of 0.25 mm is 3.0% or more, and (6) the image clarity value (JIS H 8686) as measured using an optical comb with a width of 0.125 mm is 3.0% or more.

2. The printing method according to claim 1, wherein the surface of the image protection layer is processed by changing the thermal energy applied by a thermal head so as to satisfy the conditions (1) to (6).

3. The printing method according to claim 1, wherein the surface of the image protection layer is processed by pressing a transfer roller having a roughness surface onto the surface of the image protection layer so as to satisfy the conditions (1) to (6).

4. A manufacturing method of a photographic printed material, comprising the steps of:

thermally transferring a color material of a thermal transfer sheet onto a recording medium;

further transferring an image protection layer thermally onto the recording medium having the color material thermally transferred thereon; and processing the surface of the image protection layer thermally transferred on the recording medium so as to satisfy all of the following conditions (1) to (6):

(1) the 20° relative-specular glossiness (JIS P 8142) of the surface of the image protection layer thermally transferred on the recording medium is 30% or less, (2) the image clarity value (JIS H 8686) as measured using an optical comb with a width of 2.0 mm is 30% or less, (3) the image clarity value (JIS H 8686) as measured using an optical comb with a width of 1.0 mm is 5.0% or more, (4) the image clarity value (JIS H 8686) as measured using an optical comb with a width of 0.5 mm is 4.0% or more, (5) the image clarity value (JIS H 8686) as measured using an optical comb with a width of 0.25 mm is 3.0% or more, and (6) the image clarity value (JIS H 8686) as measured using an optical comb with a width of 0.125 mm is 3.0% or more.

5. The manufacturing method according to claim 4, wherein the surface of the image protection layer is processed by changing the thermal energy applied by a thermal head so as to satisfy the conditions (1) to (6).

6. The manufacturing method according to claim 4, wherein the surface of the image protection layer is processed by pressing a transfer roller having a roughness surface onto the surface of the image protection layer so as to satisfy the conditions (1) to (6).

7. A printer apparatus comprising:

a thermal head configured to thermally transfer a color material of a thermal transfer sheet on a recording medium and to further transfer an image protection layer thermally on the recording medium having the color material thermally transferred thereon; and controlling means for controlling the thermal head, wherein, when the image protection layer is thermally transferred onto the recording medium, the controlling means controls the thermal head so as to satisfy all of the following conditions (1) to (6):

(1) the 20° relative-specular glossiness (JIS P 8142) of the surface of the image protection layer thermally transferred on the recording medium is 30% or less, (2) the image clarity value (JIS H 8686) as measured using an optical comb with a width of 2.0 mm is 30% or less, (3) the image clarity value (JIS H 8686) as measured using an optical comb with a width of 1.0 mm is 5.0% or more, (4) the image clarity value (JIS H 8686) as measured using an optical comb with a width of 0.5 mm is 4.0% or more, (5) the image clarity value (JIS H 8686) as measured using an optical comb with a width of 0.25 mm is 3.0% or more, and (6) the image clarity value (JIS H 8686) as measured using an optical comb with a width of 0.125 mm is 3.0% or more.

8. The printer apparatus according to claim 7, wherein the controlling means processes the surface of the image protection layer by changing the thermal energy applied by the thermal head so as to satisfy the conditions (1) to (6).

9. A printer apparatus comprising:

a thermal head configured to thermally transfer a color material of a thermal transfer sheet on a recording medium and to further transfer an image protection layer thermally on the recording medium having the color material thermally transferred thereon; and a control unit configured to control the thermal head, wherein, when the image protection layer is thermally transferred onto the recording medium, the control unit controls the thermal head so as to satisfy all of the following conditions (1) to (6):

(1) the 20° relative-specular glossiness (JIS P 8142) of the surface of the image protection layer thermally transferred on the recording medium is 30% or less, (2) the image clarity value (JIS H 8686) as measured using an optical comb with a width of 2.0 mm is 30% or less, (3) the image clarity value (JIS H 8686) as measured using an optical comb with a width of 1.0 mm is 5.0% or more, (4) the image clarity value (JIS H 8686) as measured using an optical comb with a width of 0.5 mm is 4.0% or more, (5) the image clarity value (JIS H 8686) as measured using an optical comb with a width of 0.25 mm is 3.0% or more, and (6) the image clarity value (JIS H 8686) as measured using an optical comb with a width of 0.125 mm is 3.0% or more.

10. The printer apparatus according to claim 9, wherein the control unit processes the surface of the image protection layer by changing the thermal energy applied by the thermal head so as to satisfy the conditions (1) to (6).

* * * * *